United States Patent [19]

Plewes

[11] 3,937,638

[45] Feb. 10, 1976

[54] METHOD FOR TREATING COPPER-NICKEL-TIN ALLOY COMPOSITIONS AND PRODUCTS PRODUCED THEREFROM

[75] Inventor: John Travis Plewes, Summit, N.J.

[73] Assignee: Bell Telephone Laboratories, Incorporated, Murray Hill, N.J.

[22] Filed: July 26, 1974

[21] Appl. No.: 492,007

Related U.S. Application Data

[63] Continuation of Ser. No. 296,011, Oct. 10, 1972, abandoned.

[52] U.S. Cl. ..... 148/12.7

[51] Int. Cl.[2] ..... C22F 1/08

[58] Field of Search ..... 148/12.7, 11.5; 75/154, 75/159

[56] References Cited

UNITED STATES PATENTS

| | | | |
|---|---|---|---|
| 1,816,509 | 7/1931 | Wise | 75/159 |
| 2,375,285 | 5/1945 | Crampton et al. | 75/154 |
| 3,488,188 | 1/1970 | Paces | 75/159 |

*Primary Examiner*—W. Stallard
*Attorney, Agent, or Firm*—G. S. Indig

[57] ABSTRACT

Certain copper-nickel-tin alloys falling within a single phase region at temperatures approaching the melting point, but within a two-phase region at room temperature, when pretreated to produce a supersaturated single phase structure having a medium to fine grain size, followed by cold working to at least 75 percent area reduction and concluding with a critical aging treatment determined by the alloy composition and by the extent of prior cold working, exhibit higher mechanical strengths for given levels of ductility than have heretofore been attained for copper alloys. The alloys of the invention are useful in a variety of applications requiring a combination of properties including mechanical strengths, ductility, electrical conductivity and corrosion resistance, and are particularly useful as springs, relay elements, wire connectors and other similar flexible articles.

10 Claims, 3 Drawing Figures

METHOD FOR TREATING COPPER-NICKEL-TIN ALLOY COMPOSITIONS AND PRODUCTS PRODUCED THEREFROM

This application is a continuation of application Ser. No. 296,011, filed Oct. 10, 1972, and now abandoned.

BACKGROUND OF THE INVENTION

This invention relates to the processing of copper-nickel-tin alloys to achieve optimum mechanical strengths for given levels of ductility, and to the resulting products.

While the highest mechanical strengths are usually associated with steel alloys, the combination of good mechanical strength, ductility, electrical conductivity and corrosion resistance exhibited by the copper alloys make them favored candidates for a wide variety of applications for which higher strengths would otherwise be desirable. Among the copper alloys, the beryllium-coppers have up to the present time exhibited the highest mechanical strengths, which have been achieved by the mechanism known as precipitation hardening. Such hardening, however, is normally accompanied by a substantial loss in ductility. For example, the highest 0.01 yield strengths (yield strength is a measure of resistance of a material to permanent deformation, a property which is particularly significant in the specification of materials for springs, relay elements, wire connectors or other similar flexible articles) which have been reported for such alloys (containing about 2 weight percent beryllium) range from about 170,000 to 175,000 pounds per square incn for textured sheet or strip. However, such strengths are accompanied by ductilities of the order of about 5 percent (ductility being defined herein as the reduction in cross-sectional area of a specimen tested in tension to its point of failure), too low for most applications requiring forming operations after hardening. Overaging to recover needed ductility is accompanied by a drop in 0.01 yield strength. For example, the 2 percent beryllium alloy may exhibit a 0.01 yield strength of 110,000 to 120,000 psi for a ductility of about 50 percent reduction in area. This drop in 0.01 yield strength as well as the high raw materials cost of beryllium and the expense of special handling due to its toxicity may make other copper alloys more desirable for certain applications.

The trend toward miniaturization and the need for increased reliability of mechanical components, particularly in the communications field, have been major factors contributing to a growing demand for alloy materials having higher yield strengths in combination with good to excellent ductilities, corrosion resistance and conductivities than have heretofore been available and at costs which would make them competitive with existing alloys. Representative of recent progress in meeting such demand is U.S. Pat. No. 3,663,311 issued to G. Y. Chin and R. R. Hart on May 16, 1972 and assigned to the present assignee. This patent describes processing of copper-beryllium, cupro-nickel, nickel-silver and phosphor-bronze alloys to achieve optimum yield strengths for given levels of ductility. Such progress invites the investigation of other alloy systems.

One such alloy system, the copper-nickel-tins, exemplified by the 5 weight percent nickel, 5 weight percent tin alloys, in general would be expected to have better corrosion resistance, better solderabilities and conductivities comparable to those of the copper-beryllium alloys. However, while good hardening response to cold working of these alloys has been observed, it has been accompanied by severe embrittlement rendering the material useless for most commercial applications. See, for example, E. M. Wise and J. T. Eash, *Metals Technology*, Jan. 1934, No. 523, page 238. Thus, with the exception of some use as age hardenable casting alloys prior to 1950, these alloys have not found significant widespread commercial use.

The discussion below is in terms of a compositional range in which the claimed alloys represent an economical alternative to cooper-beryllium alloys; specifically, this preferred range is from 4 to 40 weight percent nickel and from 3 to 12 weight percent tin, remainder copper. However, the claimed alloys may find application where cooper-beryllium is not customarily utilized. For example, alloys containing smaller amounts of nickel and/or tin are of practical interest in the manufacture of articles such as relay elements where they can be used as substitutes for the phosphor bronze alloys in current use. Specifically, alloys containing as little as 2 percent nickel and as little as 2.5 percent tin are of commercial interest.

SUMMARY OF THE INVENTION

It has now been discovered that certain copper-nickel-tin alloys falling within a single phase ($\alpha$) region of the equilibrium phase diagram for copper, nickel and tin at temperatures near the melting point of the alloy, but within a two-phase ($\alpha+\theta$) region at room temperature, when: (1) pretreated to a supersaturated single phase $\alpha$ structure at room temperature having medium to fine grain size; (2) cold worked by an amount equivalent to an area reduction of at least 75 percent; and (3) aged below a critical temperature, exhibit higher 0.01 yield strengths for given levels of ductility than have heretofore been attained for these alloys. Accordingly, such processed alloys form a part of the invention.

In accordance with a preferred embodiment, aging is carried out below the critical temperature near a temperature $T_d$ at which peak 0.01 yield strength is achieved at about the same time that ductility begins to fall below 40 percent reduction in area, resulting in higher 0.01 yield strengths for given levels of ductility than have heretofore been attained for copper alloys. Accordingly, such processed alloys form a part of the invention.

In accordance with another preferred embodiment, cold working prior to the final aging treatment by an amount equivalent to an area reduction of at least 95 percent permits the attainment of optimum mechanical properties after minimum aging times, enabling aging by a continuous or strand anneal approach.

When a level of cold working is specified herein, it is intended to mean cold working effected by one or more cold working steps, such as rolling, swaging, extruding, drawing, etc., uninterrupted by intermediate anneals. For example, rolling normally takes the form of a series of passes, each pass resulting in a thickness reduction of sheet or strip of from about 5 to 10 percent. It is intended that no intermediate anneal or other step which would alter the cold worked structure be interposed between these passes, unless specifically called for herein. The term area reduction as used herein may be defined for sheet and strip as $$\frac{T_0-T}{T_0}\times 100\ ,$$

where $T_0$ is the thickness prior to cold working and $T$ is the thickness after cold working, and for rod and wire as $$\frac{A_0-A}{A_0}\times 100\ ,$$

where $A_0$ is the diameter prior to cold working and $A$ is the diameter after cold working.

DETAILED DESCRIPTION OF THE INVENTION

Figure 1:
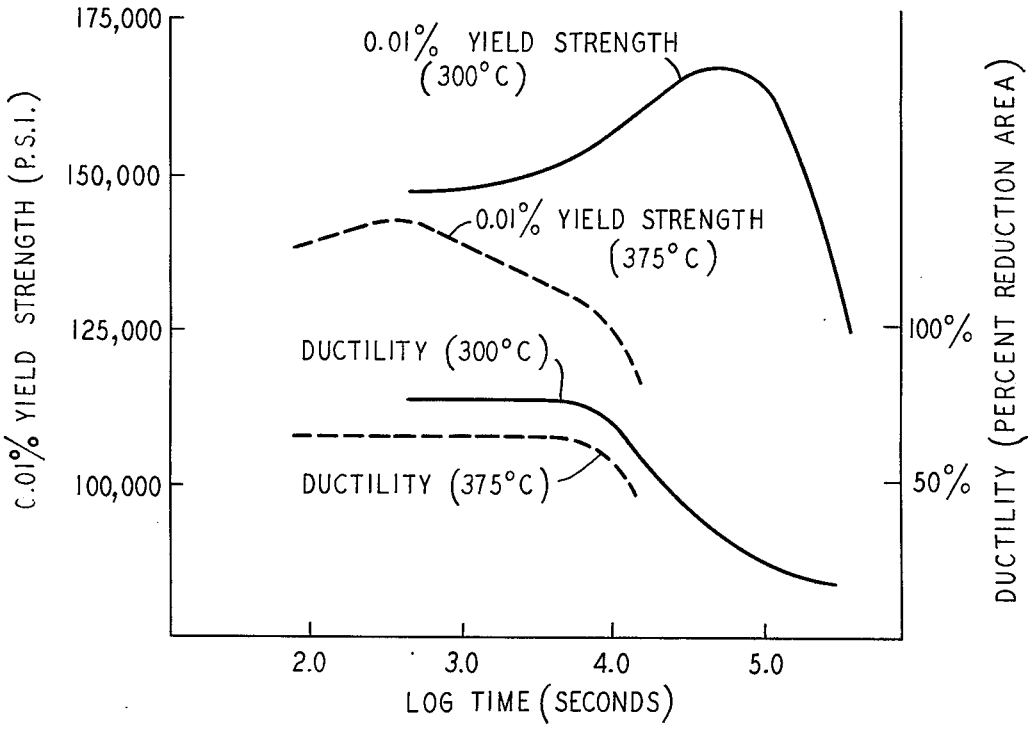
FIG. 1 is a graph of 0.01 yield strength (psi) and ductility in percent reduction in area versus log of aging time in seconds, for two different aging temperatures of a copper-nickel-tin alloy of the invention cold worked to an area reduction of 90 percent.

The alloys of the invention may be described as falling within a single phase $\alpha$ region of the equilibrium phase diagram for copper, nickel and tin, near the melting point, but within a two-phase $\alpha + \theta$ region of the equilibrium diagram at lower temperatures extending down to room temperature. In general, such alloys correspond to compositions falling with the broad compositional range of from 2 to 98 weight percent nickel, 2 to 11 weight percent tin at 2 percent nickel, and 2 to 20 weight percent tin and and 98 percent nickel, remainder copper. However, it is preferred to maintain nickel within the range of 4 to 40 weight percent, beyond which the aging time required to achieve significant increases in mechanical strength begins to become excessive. In addition, beyond 40 weight percent nickel, the raw materials cost begins to approach commercially impractical levels. It is preferred to maintain the tin content within the range of 3 to 8 weight percent at 4 percent nickel and 3 to 12 weight percent at 40 percent nickel. Below 3 percent tin the amount of second phase material available is in general insufficient to affect mechanical properties significantly, while beyond 8 to 12 weight percent tin the alloys become difficult to process, particularly during pretreatment to achieve a supersaturated single phase $\alpha$ structure.

It has been found that minor additions of some materials such as zinc and manganese typically up to about 2 weight percent and ¼ weight percent, respectively, may be beneficial in improving porosity characteristics of the cast ingots. The impurities silicon, phosphorous, lead and chromium should each be kept below about 0.05 weight percent in the composition in order to avoid a tendency of these elements to interfere with the hardening mechanism.

The first stage of the processing is designated generically as pretreatment and includes several steps designed to result in a medium to fine grain structure of a supersaturated solid solution of single phase $\alpha$ material.

This pretreatment may take any form so long as it results in the requisite single phase material having in general an average grain size of 100 microns or smaller for alloys containing less than 5 percent of tin and an average grain size of 25 microns or smaller for alloys containing 5 percent or more tin. Larger average grain sizes would in general lead to difficulty in carrying out cold working steps. It is preferable for obtaining optimum properties to have a smaller average grain size of 12 microns or smaller, regardless of the tin content. As will be appreciated, such a structure may be achieved by techniques known in the art. To aid the practitioner, an exemplary pretreatment is as follows. The cast ingot is first solution treated at a temperature within the single phase $\alpha$ region of the equilibrium diagram for a time sufficient to achieve substantial dissolution of any second phase material which may be present. The ingot is then formed into the desired shape by means which may include means for breaking up the cored structure formed during casting, such as, for example, hot forging, upset forging, or swaging (hot or cold). Forming is concluded with a cold work by an amount equivalent to an area reduction of at least 30 percent in order to insure a fine equiaxed recrystallization. The cold worked single phase structure is then annealed to achieve the desired grain size. It will also be appreciated that the annealed structure must be cooled at a rate sufficient to prevent the precipitation of any second phase material. It will ordinarily be sufficient for this purpose to air quench the alloy so long as such results in a cooling rate of at least 40° C per second. It is, however, preferred to water or brine quench alloys containing 5 percent or more tin since the kinetics of the embrittling transformation in general tend to increase with increasing tin content. Such a water or brine quench would ordinarily correspond to a cooling rate of at least 500° C per second.

In accordance with the invention, it has been discovered that an intermediate metastable state characterized by the so-called "spinodal" transformation from a single phase to a two-phase alloy, occurs in the pretreated alloy at a temperature below a metastable boundary characterized by a reversion temperature $T_m$ within the two-phase region of the equilibrium diagram, and results in considerable hardening of the alloy. However, a grain boundary second phase transformation occurs simultaneously in this region resulting in loss of ductility of peak 0.01 yield strengths. Eventually, an equilibrium lamellar two-phase structure is nucleated, resulting in an abrupt drop in yield strength.

In accordance with the invention, it has been found that a critical amount of cold work prior to aging not only inhibits grain boundary second phase formation and nucleation of the equilibrium lamellar structure, but also significantly increases the kinetics of the spinodal transformation. Thus cold working by an amount equivalent to an area reduction of at least 75 percent enables promotion of the spinodal transformation by aging below $T_m$ for a time which is insufficient to allow substantial grain boundary transformation.

The reversion temperature $T_m$ may be determined by plotting curves of isothermal resistivity changes as a function of time at various temperatures. These curves may be produced for any composition and will take one of two forms below the equilibrium boundary. The upper curves (corresponding to higher temperatures) will exhibit sigmoidal character, while the lower curves will exhibit exponential character. $T_m$ is represented by the temperature at which the curves revert from sigmoidal to exponential character.

$T_m$ is dependent both upon the amount of cold working the alloy has received and upon the composition of the alloy, particularly the tin content. The effect of tin upon $T_m$ may be appreciated, for example, by arbitrarily fixing the copper-nickel ratio at 90 to 10 and varying the tin content, resulting in a pseudo-binary $(Cu_{0.9}Ni_{0.1})_xSn_{1-x}$ system in which $T_m$ increases with increasing tin content from a minimum at about 2 percent tin to a maximum at about 6 percent and then tends to decrease again beyond 6 percent tin. Alternatively, if the copper-tin ratio is fixed and the nickel content is varied, $T_m$ increases gradually with increasing nickel content in an approximately linear manner. The exact position of the metastable boundary for any composition may be determined as described above.

Table I presents values of $T_m$ for some representative pretreated compositions of the invention.

Table I

| Composition (wt.% Ni, wt.% Sn, rem.Bu) | | Reversion Temp. ($T_m$) (±5°C) |
|---|---|---|
| 3½% Ni | 2½% Sn | 401° C |
| 5% Ni | 5% Sn | 458° C |
| 7% Ni | 8% Sn | 502° C |
| 9% Ni | 6% Sn | 508° C |
| 10½% Ni | 4½% Sn | 530° C |
| 12% Ni | 8% Sn | 555° C |

Referring now to FIG. 1, the effect of aging upon the 0.01 yield strength and ductility of a copper, 9 wt. percent nickel, 6 wt. percent tin alloy after cold working to an area reduction of 90 percent is depicted graphically for two different aging temperatures. Several features of the inventive process become apparent from an examination of these curves. For example, comparing the curves for 0.01 yield strength versus aging time shows that as aging temperature is decreased, the peak 0.01 yield strength and the aging time to achieve it are both increased. Thus, in the Figure, decreasing the aging temperature from 375° C to 300° C results in an increased peak 0.01 yield strength of about 20,000 psi and an increased aging time to this peak yield strength from about 7½ minutes to about 28 hours. Comparing the curves for ductility versus aging time shows that ductility remains approximately unaffected by aging until a critical aging time is reached at which the undesirable embrittling second phase material begins to appear, resulting in an abrupt drop in ductility. For ease in describing the effects of the process variables upon the attainment of optimum 0.01 yield strength and ductility, ductilities above 40 percent reduction in area will be arbitrarily designated as optimum, and ductilities falling below 40 percent reduction in area will be arbitrarily designated herein by the term "onset of embrittlement." It will be understood by the practitioner, however, that many applications for these alloys exist for which ductilities below these levels would be adequate.

Figure 2:
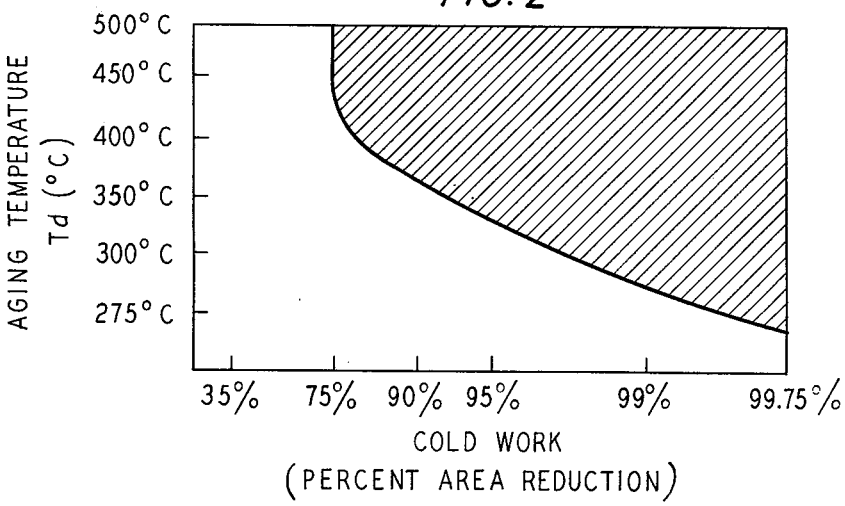
FIG. 2 is a graph of aging temperature ($T_d$) versus level of prior cold work in percent area reduction for an alloy of the invention.

It is observed by a comparison of the 0.01 yield strength curves that the aging time required to achieve peak 0.01 yield strength and the time to reach onset of embrittlement varies with aging temperature. Thus, at an aging temperature of 300° C, peak 0.01 yield strength is achieved after the onset of embrittlement whereas at k375° C peak 0.01 yield strength is achieved before the onset of embrittlement. It has been found that for every composition and every level of prior cold work within the limits described there exists an aging temperature $T_d$ at which peak 0.01 yield strength is achieved at about the same time that onset of embrittlement begins to occur. FIG. 2 shows the relationship between $T_d$ and the level of prior cold work for a copper, 9 wt. percent nickel, 6 wt. percent tin alloy. As may be seen, at least 75 percent prior cold work is necessary in order to achieve peak 0.01 yield strength accompanied by a ductility of at least 40 percent reduction in area at any temperature. As the level of cold work is increased beyond 75 percent, the aging temperature $T_d$ decreases, enabling the attainment of increased levels of 0.01 yield strength at peak value. For this reason cold working prior to aging by an amount equivalent to at least 90 percent area reduction is preferred.

Combinations of prior cold work and aging temperatures within the hatched region of FIG. 2 will result in ductilities of at least 40 percent reduction in area, but may result in less than optimum mechanical strengths.

It will be realized that even higher 0.01 yield strength values may be attained if the ductility requirement of at least 40 percent reduction in area is relaxed. For example, for the copper, 9 percent nickel, 6 percent tin alloy, cold working to 90 percent area reduction followed by aging at $T_d$ (approximately 355° C) results in a peak 0.01 yield strength of about 158,000 psi. Referring back to FIG. 1, it is seen that dropping the aging temperature below $T_d$ to 300° C results in a higher peak 0.01 yield strength of about 165,000 psi while ductility falls below 40 percent reduction in area to about 30 percent reduction in area.

In general, aging below about 225° C for any composition would require times of the order of 24 hours or longer to achieve optimum mechanical strength, too long for most commercial applications.

The shape of the curve in FIG. 2 is essentially unaffected by shifts in composition away from the copper, 9 percent nickel, 6 percent tin alloy. However, increasing the tin content or decreasing the nickel content or both tends to shift the curve upwards and to the right for a given level of cold work. For example, for a prior cold work of 99 percent area reduction, increasing the tin content from 6 to 8 percent and decreasing the nickel content from 9 to 7 percent increases $T_d$ from about 290° C to about 425° C. Decreasing the nickel content of a copper, 8 percent tin alloy from 12 to 7 percent increases $T_d$ from about 375° C to about 425° C.

FIG. 1 also shows that relaxation of the requirement to reach peak 0.01 yield strength can broaden the permissible limits of aging time or temperature or both for a given level of prior cold work. For example, it is seen that aging at a temperature of from 300° to 375° C for a time of from about 100 seconds to 3 hours results in a 0.01 yield strength of about 125,000 to 155,000 psi (from about 80 to 98 percent of peak 0.01 yield strength attainable at $T_d$) and a ductility of at least 40 percent reduction in area.

As stated above, the prior cold work increases the kinetics of the spinodal transformation, promotion of which determines the desired optimum mechanical properties. For any given aging temperature, increasing the level of prior cold work therefore decreases the time required to achieve peak properties. This effect may be seen from the following Table II which presents: optimum aging time; mechanical strength values (in psi) including 0.01 yield strength, 0.2 yield strength, and ultimate tensile strength; and ductility values (in percent reduction in area) for a copper, 9 percent nickel, 6 percent tin alloy for various aging temperatures and levels of prior cold work. For example, for an aging temperature of 400° C as cold work increases from 75 percent to 99.75 percent the optimum aging time decreases from 30 minutes to 1 second. These results suggest that aging may be carried out using a continuous or strand anneal which may be preferred, for example, in the production of rod or wire at high rates. Thus, for the attainment of optimum properties accompanied by minimum aging times, cold working by an amount equivalent to an area reduction of at least 95 percent is required and at least 99 percent is preferred.

Table II

| Aging Temp. | Prior Cold Work | Time | 0.01% Yield (±2000 psi) | 0.2% Yield (±2000 psi) | U.T.S. (±2000) psi) | %RA (±5%) |
|---|---|---|---|---|---|---|
| 300°C | 99.75% | 30 min | 188,000 | 201,000 | 202,000 | 51% |
| | 99% | 75 min | 182,000 | 200,000 | 200,000 | 52% |
| 350°C | 99.75% | 2 min | 185,000 | 201,000 | 201,000 | 58% |
| | 95% | 60 min | 172,000 | 188,000 | 191,000 | 58% |
| 375°C | 99.75% | 30 sec | 172,000 | 188,000 | 189,000 | 58% |
| | 95% | 2 min | 151,000 | 170,000 | 172,000 | 64% |
| | 90% | 5 min | 147,000 | 164,000 | 165,000 | 64% |
| 400°C | 99.75% | 1 sec | 168,000 | 189,000 | 191,000 | 64% |
| | 95% | 24 sec | 142,000 | 167,000 | 169,000 | 64% |
| | 90% | 2 min | 135,000 | 158,000 | 159,000 | 70% |
| | 75% | 30 min | 135,000 | 155,000 | 155,000 | 54% |
| 450°C | 75% | 5 min | 135,000 | 154,000 | 155,000 | 58% |
| 500°C | 75% | 10 sec | 121,000 | 141,000 | 143,000 | 60% |

Varying the composition within the stated limits also has an effect upon mechanical properties. For example, it has been observed that generally for each 1 percent increase in tin content, the peak 0.01 yield strength attainable increases by about 30,000 psi. However, as the tin level increases beyond about 6 percent, it becomes more difficult to maintain ductility above the 40 percent reduction in area level.

Table III shows the combinations of prior cold work and aging conditions resulting in optimum strength and ductility levels for some representative compositions. As may be seen from the Table, the highest ductility and lowest 0.01 yield strength were obtained for the 2½ percent tin alloy, while the lowest ductility and highest 0.01 yield strength were obtained for the 12 percent nickel, 8 percent tin alloy.

Table III

| Alloy (%Ni,%Sn, rem.Cu) | Prior Cold Work & Aging Temp. | Time | 0.01% Yield (±2000 psi) | UTS (±2000 psi) | %RA (±5%) |
|---|---|---|---|---|---|
| 7% Ni-8%Sn | 99% cold work + 425°C | 8 sec | 173,000 | 210,000 | 47% |
| 12%Ni-8%Sn | 99% cold work + 400°C | 10 sec | 192,000 | 227,000 | 46% |
| 14%Ni-6% Sn | 99% cold work + 350°C | 5 min | 176,000 | 206,000 | 54% |
| 10½% Ni-4½% Sn | 99.75% cold work + 350°C | 5 min | 154,000 | 181,000 | 63% |
| 3½% Ni-2½% Sn | 99% cold work + 250°C | 4 hrs | 95,000 | 127,000 | 75% |
| 5% Ni-5% Sn | 99% cold work + 320°C | 2 min | 160,000 | 192,000 | 51% |

Table IV shows cold work and aging conditions resulting in optimum mechanical strength regardless of ductility for the copper, 7 percent Ni, 8 percent tin and copper, 12 percent Ni, 8 percent tin alloys.

Table IV

| Alloy (%Ni,%Sn, rem.Cu) | Prior Cold Work & Aging Temp. | Time | 0.01% Yield (±2000 psi) | UTS (±2000 psi) | %RA (±5%) |
|---|---|---|---|---|---|
| 7%Ni-8%Sn | 99% cold work + 300°C | 15 sec | 196,000 | 224,000 | 6% |
| 12%Ni-8%Sn | 99% cold work + 250°C | 1½ hr | 219,000 | 246,000 | 10% |

The following example compares the effects of annealing; annealing and aging; and annealing, cold working and aging upon the mechanical strength and ductility of a copper, 9 percent nickel, 6 percent tin alloy.

EXAMPLE

Copper, nickel and tin were alloyed in an induction furnace under a helium atmosphere to give a 9 percent nickel, 6 percent tin, 85 percent copper composition. The alloy melt was cast into 1 inch diameter rods at about 100° C above the melting point. The rods were then solution treated at 800° C for 5 hours under a hydrogen atmosphere, followed by cold working by swaging with intermediate anneals at 800° C to break up the cored structure, resulting in a reduction of the diameter of the rods to 0.5 inch. The rods were then turned down on a lathe to 0.4 inch diameter to remove surface scale. They were then cold swaged further to 0.2 inches in diameter, corresponding to an area reduction of about 75 percent and annealed at 800° C for 5 minutes in hydrogen and water quenched. The rods were then in a substantially supersaturated solid solution of $\alpha$ phase having an average grain size of about 12 microns. The rods were then cold drawn to final diameters of 0.02 inches and given various additional treatments prior to testing as follows. One batch of wire was annealed at 800° C for 5 minutes and water quenched. A second batch was annealed and aged at 350° C for various times to determine time to peak 0.01 yield strength. A third batch was reduced to the appropriate intermediate level, annealed and further drawn to the final 0.02 inch diameter corresponding to an area reduction of 95 percent. They were then aged at 350° C for various times to determine time to peak 0.01 yield strength. The fourth batch was cold drawn to a final diameter of 0.010 inches without an intermediate anneal, corresponding to an area reduction of 99.75 percent, and aged at 350° C to peak 0.01 yield strength. Aging was carried out in a salt bath composed of a fifty-fifty mixture of sodium nitrite and potassium nitrate. The specimens were then tested in tension for yield strengths at both 0.01 and 0.2 percent offset, (using a load-unload technique), for ultimate tensile strengths and ductility, using a strain rate of 0.05 inches per minute. The results are shown in Table V, which includes aging time to peak 0.01 yield strength.

Table V

| Batch No. | Aging Time (min.) | 0.01% Yield Strength (psi) | 0.2% Yield Strength (psi) | UTS (psi) | Ductility (%RA) |
|---|---|---|---|---|---|
| 1 | — | 10,000 | 40,000 | 66,000 | 84 |
| 2 | 4800 | 85,000 | 122,000 | 135,000 | 6 |
| 3 | 60 | 172,000 | 191,000 | 191,000 | 58 |
| 4 | 2 | 185,000 | 203,000 | 203,000 | 57 |

It may be seen from the Table that annealing the sample after cold working results in very low mechanical strength and very high ductility (Batch No. 1) whereas annealing followed by aging to peak 0.01 yield strength results in much increased mechanical strength but is accompanied by a severe drop in ductility (Batch No. 2) Annealing, cold working and aging in accordance with the procedure of the invention results in even higher mechanical strengths accompanied by good ductilities (Batches 3 and 4). Thus, cold working to 95 percent area reduction prior to aging more than doubles the 0.01 yield strength over that obtained simply by aging while at the same time maintaining ductility of 58 percent as compared to only 6 percent for the aged material. Increasing cold working to 99.75 percent further increases 0.01 yield strength by more than 10,000 psi with no apparent loss in ductility. Furthermore, cold working results in a substantial decrease in aging time to peak mechanical strength. For example, aging time is decreased from 4800 minutes to only 60 minutes when aging is preceded by a 95 percent cold reduction and is further decreased to 2 minutes for a 99.7 percent cold reduction.

Figure 3:
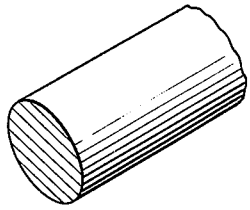
FIG. 3 depicts an article composed of an alloy composition of the invention processed as described herein.

FIG. 3 depicts an article such as a wire or rod section composed of an alloy composition of the invention processed as described herein. Due to their higher mechanical strengths and ductilities than have heretofore been attained, these alloys as processed herein form a part of the invention.

The invention has been described in terms of a limited number of embodiments. Other embodiments will become apparent to those skilled in the art from the teachings set forth herein and these embodiments are intended to be encompassed within the scope of the description and the appended claims.

The terms "spinodal transformation," "grain boundary second phase transformation," and "discontinuous lamellar structure" have been used herein. While substantial evidence exists to support an explanation of the hardening and embrittling mechanisms based upon the use of these terms, the accuracy of such an explanation is not relied upon to define the invention since the processing necessary in order to achieve the desired mechanical properties of the final alloy composition has been fully described herein.

Finally, and as mentioned earlier, the discussion above is in terms of a preferred compositional range in which the claimed alloys can serve as substitutes for copper-beryllium. However, alloys within the claimed range may find application where copper-beryllium is not customarily used. Specifically, alloys with smaller amounts of nickel and/or tin are of commercial interest as substitutes for phosphor bronze.

What is claimed is:

1. A method for producing a copper-nickel-tin alloy comprising cold working and aging characterized by a. providing an alloy consisting essentially of a composition within the single phase $\alpha$ region of the equilibrium ternary phase diagram for copper, nickel and tin at temperatures approaching the melting point of the alloy but within the two-phase $\alpha + \theta$ region of the diagram at room temperature, in a supersaturated solid solution of $\alpha$ phase having medium to fine grain size, b. cold working the alloy by an amount equivalent to an area reduction of at least 75 percent, and c. aging the alloy at a temperature below the metastable boundary $T_m$ of the alloy, $T_m$ being defined as the temperature at which curves produced by isothermal resistivity changes as a function of time revert from a sigmoidal to an exponential character.

2. The method of claim 1 in which the alloys consist essentially of from 2 to 40 weight percent nickel, from 2.5 to 8 weight percent tin at 2 percent nickel and from 2.5 to 12 weight percent tin at 40 percent nickel, remainder copper.

3. The method of claim 1 in which the alloy consists essentially of from 4 to 40 weight percent nickel, from 3 weight percent tin to 8 weight percent tin at 4 percent nickel, and from 3 to 12 weight percent tin at 40 percent nickel, remainder copper.

4. The method of claim 1 in which the alloy provided for cold working and aging contains up to 5 percent tin and has an average grain size of up to 100 microns.

5. The method of claim 1 in which the alloy provided for cold working and aging contains at least 5 percent tin and has an average grain size of up to 25 microns.

6. The method of claim 1 in which the alloy provided for cold working and aging has an average grain size of up to 12 microns.

7. The method of claim 1 in which cold working is carried out by an amount equivalent to an area reduction of at least 90 percent.

8. The method of claim 7 in which cold working is carried out by an amount equivalent to an area reduction of at least 95 percent.

9. The method of claim 8 in which cold working is carried out by an amount equivalent to an area reduction of at least 99 percent.

10. The product produced by the method of claim 1.

* * * * *